US005226601A

United States Patent [19]

Hinojosa, Jr. et al.

[11] Patent Number: 5,226,601

[45] Date of Patent: Jul. 13, 1993

[54] DUAL NOZZLE HYDROTHERAPY JET WITH ENHANCED AERATION

[75] Inventors: Francisco Hinojosa, Jr., Palmdale; Eugene M. Gravatt, Valencia, both of Calif.

[73] Assignee: B&S Plastics, Inc., Oxnard, Calif.

[21] Appl. No.: 788,779

[22] Filed: Nov. 6, 1991

[51] Int. Cl.[5] ..... B05B 7/08; E03C 1/084

[52] U.S. Cl. ..... 239/423; 239/428.5

[58] Field of Search ..... 239/428.5, 417.3, 416.5, 239/416.4, 423; 4/540–542

[56] References Cited

U.S. PATENT DOCUMENTS

| | | | |
|---|---|---|---|
| 3,946,449 | 3/1976 | Mathis . | |
| 3,985,303 | 10/1972 | Steimle | 239/428.5 |
| 4,010,902 | 3/1977 | Speyer | 239/428.5 |
| 4,335,854 | 6/1982 | Reynosa | 239/428.5 |
| 4,408,721 | 10/1983 | Cohen et al. | 239/428.5 X |
| 4,508,665 | 4/1985 | Spinnett . | |
| 4,593,420 | 6/1980 | Tobias et al. | 239/428.5 X |
| 4,671,463 | 6/1987 | Moreland et al. | 239/428.5 |
| 4,692,950 | 9/1987 | Henkin et al. . | |
| 4,715,071 | 12/1987 | Henkin et al. . | |

FOREIGN PATENT DOCUMENTS

| | | | |
|---|---|---|---|
| 865717 | 2/1940 | France | 239/428.5 |

*Primary Examiner*—Andres Kashnikow
*Assistant Examiner*—Kevin P. Weldon
*Attorney, Agent, or Firm*—Koppel & Jacobs

[57] ABSTRACT

A greater volume of air is entrained in the water flow from a hydrotherapy jet by directing the discharge from a first venturi nozzle through a second nozzle that constrains and accelerates the flow. For greatest aeration the ratio of the discharge orifice diameter for the first nozzle to that of the second nozzle is about 0.7–0.85, the ratio of the distance between the discharge orifices for the two nozzles and the diameter of the first nozzle's discharge orifice is about 0.85–1.5, air is introduced into the discharge from the first nozzle from a location fully behind that nozzle's discharge orifice, the flow of air to the downstream side of the second nozzle's discharge orifice is blocked, and the upstream end of the second nozzle overlaps the downstream end of the first nozzle.

2 Claims, 2 Drawing Sheets

DUAL NOZZLE HYDROTHERAPY JET WITH ENHANCED AERATION

BACKGROUND OF THE INVENTION

1. Field of the Invention

This invention relates to a hydrotherapy jet for discharging an air/water mixture, and to a related method of forming the discharge.

2. Description of the Prior Art

Hydrotherapy jets such as those used in spas and bathtubs normally direct a stream of water through an open-ended conical nozzle that constricts and accelerates the water flow. Upon discharge from the nozzle, the flow of water expands, dropping in pressure and entraining a stream of air in a venturi action. The air/-water mixture is discharged from the jet through a discharge member that can be either stationery and provide a controlled discharge direction, or rotating to provide a massaging effect.

It is generally desirable to maximize the amount of air entrained in the discharge. This has been found to produce a pleasing feel for most users. However, present hydrotherapy jets are limited in the amount of static vacuum that can be built up at the nozzle outlet, and thus in the amount of air that can be drawn into the flow.

SUMMARY OF THE INVENTION

The present invention seeks to provide a new hydrotherapy jet design and operating method that draws more air into the stream of water discharged by the jet. This is accomplished with a dual nozzle venturi arrangement in which water is directed through a first venturi nozzle, air is entrained in the water discharge downstream from the first nozzle, and the water/air flow is then constrained and thus accelerated by directing it through a second nozzle. This has been found to significantly increase the entrainment of air in the resultant discharge from the second nozzle.

The two nozzles preferably have tapered frusto-conical shapes, with the upstream end of the second nozzle overlapping the first nozzle's downstream end. To enhance the vacuum formed at the outlet from the first nozzle, and thus the amount of air entrained in the flow, the second nozzle's discharge orifice is made somewhat larger than that of the first nozzle. The ratio of the diameter of the first nozzle to that of the second nozzle is preferably in the approximate range of 0.7–0.85, while the ratio of the distance between the two discharge orifices and the diameter of the first nozzle's orifice is in the approximate range of 0.85–1.5. Air entrainment is further enhanced by configuring an air inlet passageway such that air is introduced to the periphery of the first nozzle upstream from its discharge orifice, and by blocking the flow of air from the air inlet to the area immediately downstream from the second nozzle's discharge orifice.

These and other further features and advantages of the invention will be apparent to those skilled in the art from the following detailed description, taken together with the accompanying drawings, in which:

DETAILED DESCRIPTION

Figures 1, 2:
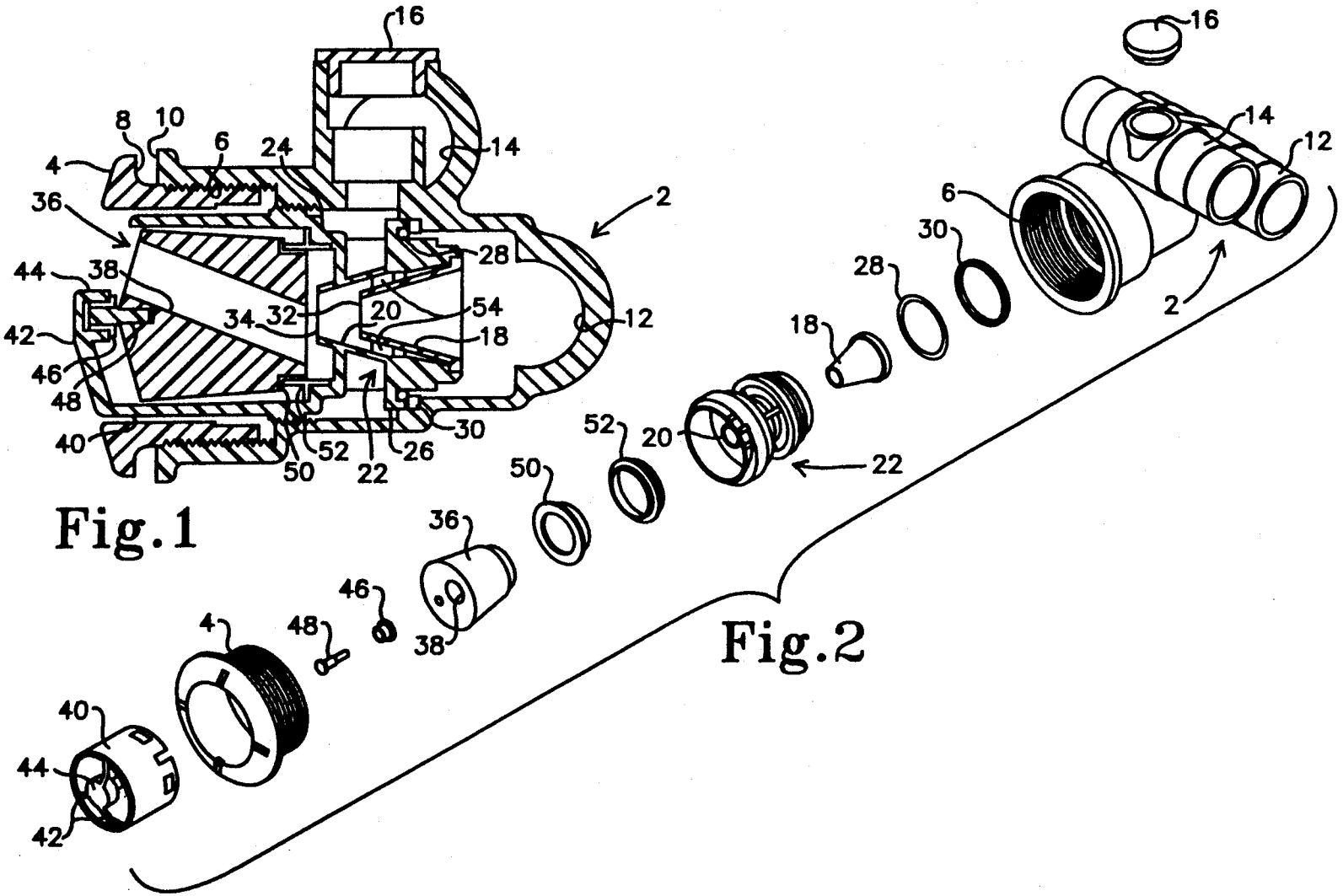
FIG. 1 is a sectional view of a hydrotherapy jet assembly employing the dual discharge nozzles of the present invention.
FIG. 2 is an exploded perspective view of the hydrotherapy jet shown in FIG. 1.

A preferred implementation of the invention is shown in FIGS. 1 and 2. This is a hydrotherapy jet for use in spas. Smaller scale versions of this jet can also be used in hydrotherapy bathtubs, and the unique dual nozzle design which it employs is applicable in general to other applications in which a liquid/air venturi discharge is desired with a large proportion of air.

The device includes a jet body 2 that provides a casing for the operative elements. The jet body is installed on a spa in a conventional manner, with a screw-on retainer fitting 4 at the forward end of the body extending through a corresponding opening in the spa wall to screw into a threaded cavity 6 in the jet body. The body is retained in place on the outside of the spa wall, with the wall clamped between opposed flanges 8 and 10 on the retainer fitting and body, respectively.

Water and air are introduced into the jet body respectively through water and air inlets 12 and 14. These inlets are conventionally plumbed by means of connecting conduits to adjacent jets around the periphery of the spa, so that water and air under pressure can be provided to each of the jets in line. The water pressure is typically in the range of about 8–15 psi. A plug 16 is provided at the upper end of the air inlet 14 to allow venting of this inlet to the atmosphere above the spa, if desired in lieu of a pressurized air source.

An aerated water discharge is created through the jet by means of a dual nozzle arrangement consisting of a first upstream nozzle 18, and a second downstream nozzle 20. The downstream nozzle 20 is preferably formed integrally with a frame 22 that includes forward and rear flanges 24 and 26, respectively. The forward flange 24 has an outside threaded surface that engages corresponding threads on the interior surface of the jet body cavity 6, inward from the retainer fitting. The rear flange 26 retains an O-ring 28 on its rearward facing side. When the mounting frame 22 is threaded into place on the jet body, O-ring 28 bears against a wear ring 30, held in the interior of the jet body surface, to prevent water flowing around the frame 22 from inlet 12.

The first nozzle 18 is preferably snap-fit into a recess at the rear of the hollow mounting frame. It is downstream to receive water from the water inlet 12, while its discharge orifice 32 discharges received water towards the discharge orifice 34 for the second nozzle 20.

The jet also includes a rotational outlet member 36 that discharges into the spa. As shown, the outlet member rotates in response to receiving a discharge from the nozzles. For this purpose it includes an offset opening 38 through which the discharge from the nozzles flows, with the opening angled to the outlet members' axis to cause it to rotate.

The outlet member 36 is held in place at its forward end by a retainer 40 that is snap fit over the forward end of the mounting frame flange 24. Arms 42 extend from the outer end of the retainer to the forward end of the outlet member, with a rearward directed cup 44 at the end of the arms holding a bushing 46. A pin 48 is held in turn in the bushing 46, and extends into a corresponding axial opening at the front end of the outlet member 36 to hold it in place.

The rear of the outlet member 36 is held in place by means of adjacent bushings 50, 52 that are retained at the rear of the outlet member and on the interior surface of the mounting frame 20, respectively. A slight clearance between the two bushings 50 and 52 allows the outlet member to rotate about pin 48 without unduly wobbling.

Figure 3:
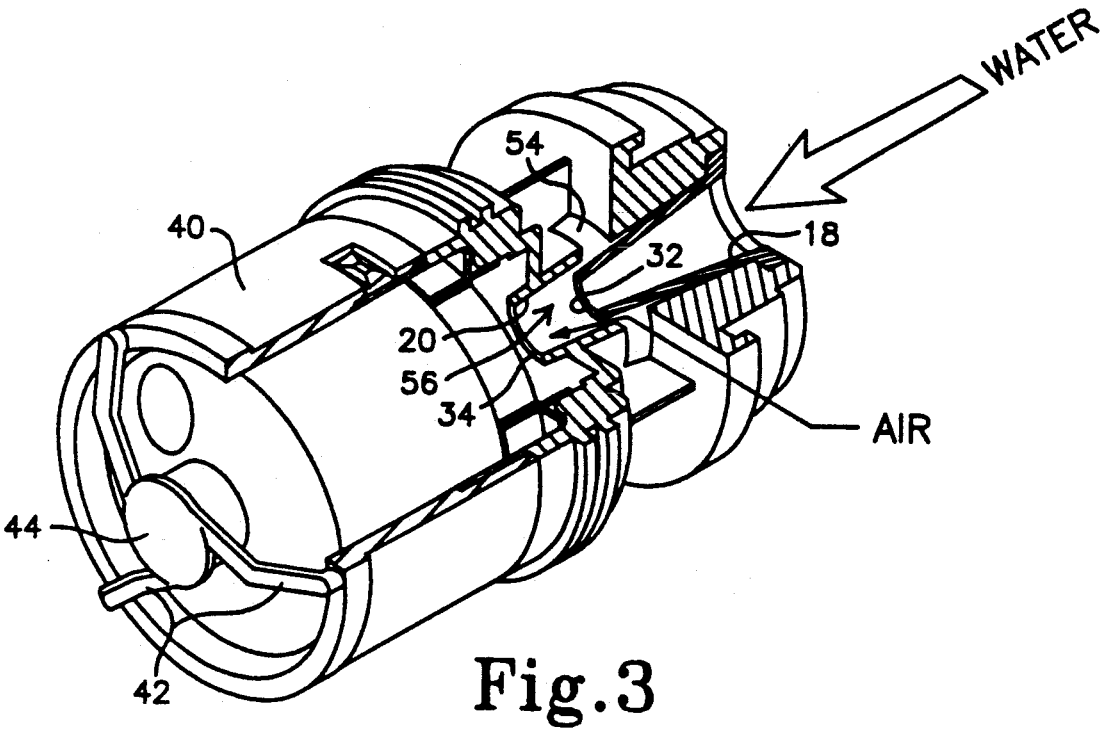
FIG. 3 is a broken away perspective view of the mounting insert and dual nozzle structure of the hydrotherapy jet shown in FIG. 1, illustrating the flow of water and air through the nozzle.

The mounting frame 22 includes peripheral openings 54 near the rear or upstream end of the second nozzle 20. The openings 54 form an air passageway between the air inlet 14 and the periphery of the first nozzle 18. The operation of the device is illustrated in FIG. 3, which shows the openings 54 more clearly. Pressurized water enters the upstream end of the first nozzle 18, which preferably has a tapered frusto-conical shape. The nozzle thus provides a progressively narrower water passage, causing the water to accelerate and to produce a partial vacuum upon exiting the discharge orifice 32. The area within the second nozzle immediately downstream from the first nozzle's discharge orifice 32 constitutes a mixing chamber 56 within which air is drawn from the air inlet 14, through passageways 54, and entrained into the water flow as a consequence of the partial vacuum formed in the chamber 56. The first nozzle 18 thus constitutes a venturi, and by itself may be considered to operate in a conventional manner.

The provision of a second nozzle 20 downstream from the first nozzle's discharge orifice 32 has been discovered to alter the water/air flow so as to significantly increase the static vacuum within the chamber 56, and thus increase the volume of air drawn into the water discharge. The water/air flow expands as it proceeds away from the first nozzle 18, and this expanding flow is constricted and accelerated upon reaching the inner surface of the second nozzle 20. The net result has been found to be a substantial increase in the aeration of the jet's discharge, as compared to its aeration with only a single nozzle 18.

The second nozzle 20 preferably also has a tapered frusto-conical shape. While an enhanced entrainment of air can be achieved over a fairly wide range of geometric configurations, larger increases in air flow can be achieved by following several specific design criteria which the present inventors have developed.

First, a larger entrainment of air results if the diameter of the second discharge orifice 34 is larger than that of the first discharge orifice 32, such that the ratio of the first nozzle's discharge orifice diameter to that of the second nozzle is in the approximate range of 0.7–0.85. Within this range, even better air flow is achieved if the distance between the first and second discharge orifices, as a proportion of the first discharge orifice's diameter, is held within the approximate range of 0.85–1.5.

Second, more air is entrained into the water flow if the air passageways 54 are fully behind (upstream from) the discharge orifice 32 for the first nozzle. With other conditions held constant, moving the air passageway in front of (downstream from) the first nozzle's discharge orifice reduces the amount of air drawn into the water flow.

Third, blocking the flow of air from the air inlet 14 to the downstream side of the second nozzle's discharge orifice 34 has also been found to increase the amount of air brought into the flow. This function is accomplished by the mounting frame 22, in which the forward flange 24 and exterior surface of the integrally formed second nozzle 20 block the flow of air from the air inlet 14 to the outside of the second nozzle's discharge orifice.

Fourth, it is desirable that the first nozzle's discharge orifice 32 extend into the interior of the second nozzle. In other words, the upstream end of the second nozzle preferably overlaps the downstream end of the first nozzle. This produces more of a closed mixing chamber 56.

The present invention has been found to increase the static vacuum at the outlet of the first nozzle's discharge orifice (with the air inlet 14 closed off) by a factor of 4 or more, compared to a conventional single-nozzle hydrotherapy jet. With one version of the invention, the static vacuum was increased from about 7 kilopascals (kpa) for a single-nozzle jet to about 27 kpa with the dual nozzle of the present invention. A later version of the invention had fewer air leaks, and produced even greater static vacuums. (All vacuum measurements were gage)

Figure 4:
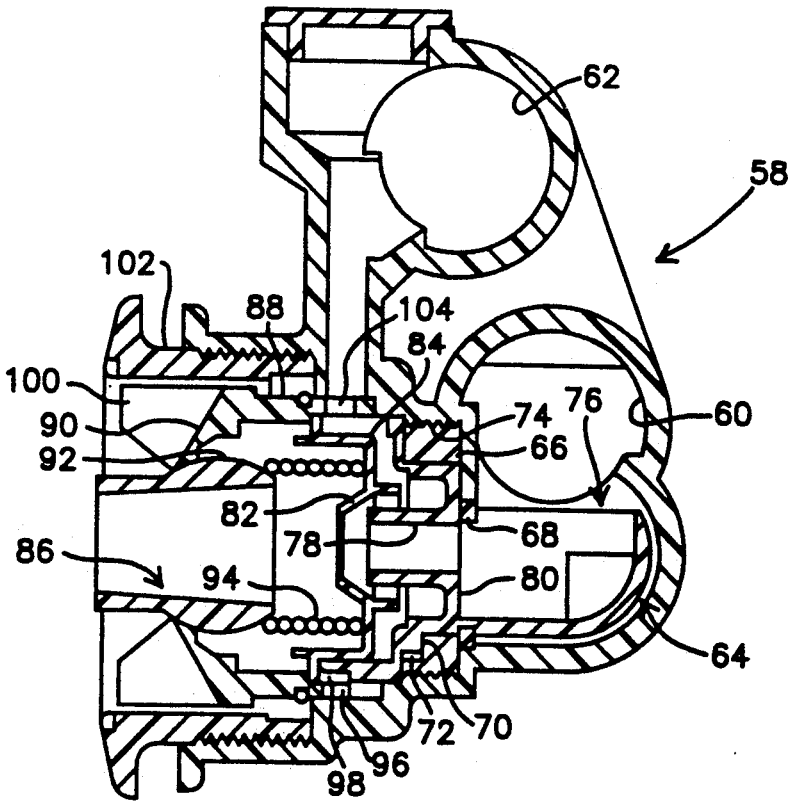
FIG. 4 is a sectional view of a second hydrotherapy jet showing another embodiment of the invention.

Another embodiment of the invention is shown in FIG. 4. This embodiment employs a stationery outlet, and has an adjustable water inlet so that the water flow can be set at any desired level from fully on to fully off. It includes a jet body 58 with water and air inlet 60 and 62, respectively. The operative elements are mounted on a carriage 64 that extends rearwardly under the water inlet. An exterior threaded retainer ring 66 is held on the carriage by a snap clip 68 that allows the retainer ring to rotate about the carriage. A key 70 on the exterior of the carriage lodges in a keyway 72 formed in the inner surface of the retainer ring to limit to amount the carriage can rotate with respect to the ring. To provide for fully on through fully off water flow, the carriage 64 is permitted to rotate by 180° with respect to the retainer ring 66, by extending the keyway 180° (plus an allowance for the thickness of the key) around the keyway 72.

The carriage is mounted within the jet by screwing the retainer ring threads into corresponding threads 74 formed on the inner surface of the jet body. The carriage 64 includes a cup 76 at its rear end that faces directly up, receiving a flow from the water inlet 60, when the key 70 is at one end of the keyway 72. In this position the water flow is fully on. The carriage can be rotated 180° from this position so that the underside of the cup faces up towards the water inlet, shutting off the flow of water, or to any desired intermediate position.

The carriage includes an integrally formed first nozzle 78 carried on a web 80 to receive a water flow from the cup 76. In this embodiment the first nozzle is tubular rather than conical. However, it still serves to accelerate received water and form a venturi to entrain air that flows in from the air inlet 62. A second nozzle 82 is provided downstream from and in-line with the first nozzle 78, and is held in place by a bushing 84 that in turn is snap-fit into place at the forward end of the carriage 64.

A jet outlet member in the form of a swivel "eyeball" nozzle 86 is held downstream from the two nozzles 78,82 by an outlet casing 88 that includes an annular, forward extending retainer ring 90. This ring bears against the forward edge of the eyeball nozzle's bulbular portion 90 to prevent the eyeball nozzle from falling out. A coil spring 94 is compressed between the rear of the eyeball nozzle and the forward face of bushing 84, urging the eyeball nozzle against the retainer ring 90.

This tends to hold the eyeball nozzle stationary, while still allowing it to be rotated to change the direction of the jet discharge by the user.

The outlet casing 88 extends rearward and is mounted to the forward end of the carriage 64 by means of spaced openings 96 around the outlet casing's lower portion that receive corresponding snap detents (not shown) around the opposed portion 98 of the carriage 64. When snapped together, the carriage 64, outlet casing 88 and eyeball nozzle 86, together with the associated nozzles 78,82 and retainer ring 66, form a unitary assembly that can be easily mounted to, or dismounted from, the jet body. This is accomplished by simply rotating the assembly so that the retainer ring 66 either threads onto or off of the interior thread 74 in the jet body. Forward extending vanes 100 at the forward end of outlet casing 88 are provided for this purpose; they can be gripped either by hand or with a wrench to rotate the casing. As with the embodiment of FIGS. 1-3, a wall fitting 102 screws into the threaded interior of the jet body around its outlet, with opposed flanges on the wall fitting and jet body clamping the jet to the spa wall.

In operating air flows from the air inlet 62 through an elongate opening 104 that extends about 90° around the upstream portion of the outlet casing 88, and from there around the rear of the second nozzle 82 to the area immediately downstream from the discharge orifice for the first nozzle 78. To obtain maximum air entrainment in the jet stream, design considerations similar to those for the embodiment of FIGS. 1-3 apply. These include the relative sizes of the discharge orifices for the first and second nozzles and the spacing therebetween, the provision of an air flow to the periphery of the first nozzle 84 upstream from its discharge orifice, overlapping the downstream end of the first nozzle 78 with the upstream end of the second nozzle 82, and blocking the flow of air from air inlet 62 to the forward end of the second nozzle 82 (by means of bushing 84).

Numerous other design modifications can be made to the size, shape and relative positioning of the first and second nozzles, the type of outlet member and the water and air inlet arrangements, while still obtaining an increased air flow through the jet in accordance with the principals of the invention. Accordingly, it is intended that the invention be limited only in terms of the appended claims.

We claim:

1. A venturi nozzle assembly, comprising:

first and second frusto-conical tapered nozzles having respective discharge orifices, the first nozzle configured to accelerate and discharge a received flow of water through the second nozzle, the second nozzle configured and positioned to constrict and accelerate a flow received from the first nozzle before said flow has had an opportunity to substantially expand, a mounting member carrying said first and second nozzles, and an air passageway through said mounting member providing air communication between the exterior of the mounting member and the area between the discharge orifices of said first and second nozzles, said first nozzle comprising a venturi to entrain air from said air passageway in water which it discharges, said second nozzle accelerating said discharge from the first nozzle to increase the vacuum in the area between the discharge orifices and thereby the entrainment of air in said discharge, wherein the second nozzle's discharge orifice is larger than the first nozzle's discharge orifice, and the ratio of the diameter of the first nozzle's discharge orifice to the diameter of the second nozzle's discharge orifice is in the approximate range of 0.7–0.85.

2. The venturi nozzle assembly of claim 1, wherein the ratio of the distance between the discharge orifices for the first and second nozzles to the diameter of the first nozzle's discharge orifice is in the approximate range of 0.85–1.5.

* * * * *